US005363980A

United States Patent [19]

Mulcahy

[11] Patent Number: 5,363,980

[45] Date of Patent: Nov. 15, 1994

[54] COMBINATION DISPOSABLE WASTE CONTAINER

[76] Inventor: Stephen J. Mulcahy, 115 Norfolk St., Cranston, R.I. 02910

[21] Appl. No.: 124,584

[22] Filed: Sep. 22, 1993

[51] Int. Cl.[5] ..... B65D 90/04

[52] U.S. Cl. ..... 220/404; 220/407; 220/462; 383/37; 206/554

[58] Field of Search ..... 383/37, 33; 206/554; 220/403, 404, 407, 462

[56] References Cited

U.S. PATENT DOCUMENTS

| | | | |
|---|---|---|---|
| 2,725,141 | 11/1955 | Latvala et al. | 206/554 X |
| 3,233,816 | 2/1966 | Cherrin | 220/462 |
| 3,448,913 | 6/1969 | Wolff | 220/407 X |
| 3,512,338 | 5/1970 | Nestler | 383/37 X |
| 3,608,712 | 9/1971 | Savoie | 206/554 X |
| 3,888,406 | 6/1975 | Nippes | 220/462 X |
| 4,978,231 | 12/1990 | Ling et al. | 383/37 X |
| 4,989,994 | 2/1991 | Gelbard | 383/37 |

*Primary Examiner*—Allan N. Shoap
*Assistant Examiner*—Jes F. Pascua
*Attorney, Agent, or Firm*—Robert J. Doherty

[57] ABSTRACT

A disposable waste container having a substantially rigid shell to which a stack of nested plastic bags is attached and supported thereby. The bags are serially separable from each other, and the outermost of the bag stack permanently attached to the shell for ultimate disposal therewith. The entire unit is collapsible by flattening the shell with the bag stack mounted therein for ease in transportation and storage.

8 Claims, 2 Drawing Sheets

COMBINATION DISPOSABLE WASTE CONTAINER

BACKGROUND AND OBJECTS OF THE INVENTION

This invention relates to a dispensing package and more particularly a package of the type in which a plurality of disposable bags are nested within one another such that they may be serially disposed of as filled. In order to support the nested bag assembly, a container shell or frame which is foldable to a collapsed form is utilized to which the nested bag stack is permanently attached such that the combination assembly forms a single package and which may be discarded after the last bag is used. In order to accomplish such, the frame is preferably formed of a low cost material such as paperboard or cardboard which folds easily and then, in essence, unfolded or erected to the use position. The bags are preferably formed from a suitable plastic material.

Multiple bag dispensers are generally known and often take the form of a nest or assemblage of a plurality of bags which are supported by a permanent structure and when the last of such nest of bags is utilized, it is replaced with a subsequent nest along with the attendant trouble and difficulty of assembling the two units together. Examples of such prior art devices are shown by Knowles et al in U.S. Pat. No. 4,417,669 issued Nov. 29, 1983 in which the nested stack of disposable plastic bags is attached to various permanent structures and adapted to be serially dispensed therefrom. A similar overall system is shown by U.S. Pat. No. 3,392,825 to Gale et al issued Jul. 16, 1968 in which a container houses a plurality of accordian-folded bags which are adapted to pull up through the top of the bag when one has been dispensed. Another arrangement of interest is shown by the patent to Ling et al, U.S. Pat. No. 4,978,231, issued Dec. 18, 1990 in which a nested arrangement of plastic bags is secured over a waste bin and serially dispensed therefrom. In all the above instances, it should be pointed out that the support structure is neither foldable with nor disposable after the last to be dispensed plastic bag such that a number of convenient features desirable in the present invention are absent.

Another prior art structure of interest is shown by Bergstein in U.S. Pat. No. 4,099,665 issued Jul. 11, 1978 in which a foldable carton includes product containing liners 21 attached thereto and arranged for opening and subsequent re-closing to protect the contents thereof from moisture. Obviously no multiple dispensing concept is involved with the structure of this patent. Other patents of which the applicant is aware and which are of general interest to this invention include the following patents: U.S. Pat. No. 4,457,483 issued Jul. 3, 1984, U.S. Pat. No. 4,869,391 issued Sep. 26, 1989, U.S. Pat. No. 4,989,994 issued Feb. 5. 1991 and U.S. Pat. No. 5,040,902 issued Aug. 20, 1991.

From the foregoing, it may be seen that the need for a package of this general type in which bags may be serially dispensed therefrom and then the entire remaining package discarded as a unit and one which can be folded during shipment and prior to use to conserve space and increase the convenience of the article is still needed. Accordingly, these and other objects of the present invention are accomplished by the provision of a combination disposable package comprising a substantially rigid yet foldable outer container shell having a stack of a plurality of collapsible nested bags attached thereto and in turn disposed for serial detachment therefrom, said outer shell having a pair of opposed primary panels interconnected along vertically oriented primary fold lines to a pair of secondary panels each in turn having a centrally disposed vertically oriented secondary fold line such that the shell can be substantially flattened upon itself in a storage position wherein the side panels are folded along said secondary fold lines and then opened to its use position wherein the side panels are unfolded to an open position wherein the shell defines an open upper top peripheral edge, said collapsible bags each having a closed body and an open upper lip, said bags nested together and interconnected to adjacent bags along a line at their upper lips, said upper lips of said nested bag stack folded over said open upper top peripheral edge of said shell and the nested body portions of said bags disposed adjacent the inside surfaces of said shell panels such that trash may be placed into the body of the innermost bag of said nested stack and then said innermost bag detached from the bag stack and serially disposed of until only said outermost bag and said shell remain as the combination package and may be disposed of as a unit.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

Figure 1:
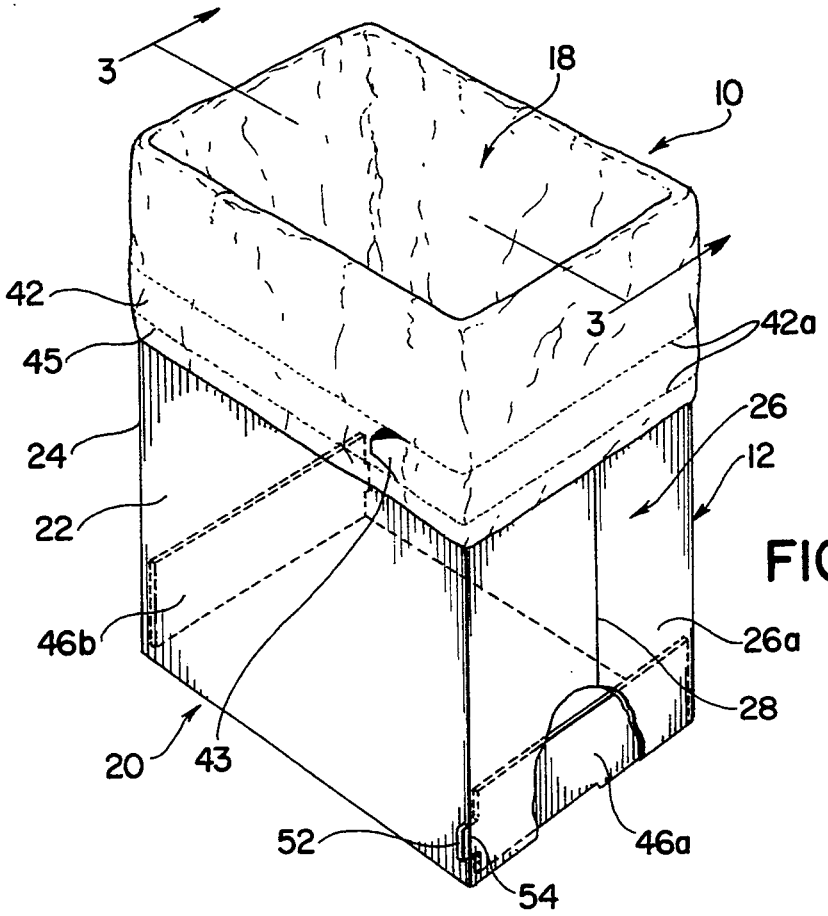
FIG. 1 is a perspective view of the device of the present invention in its erected use position.
Figure 2:
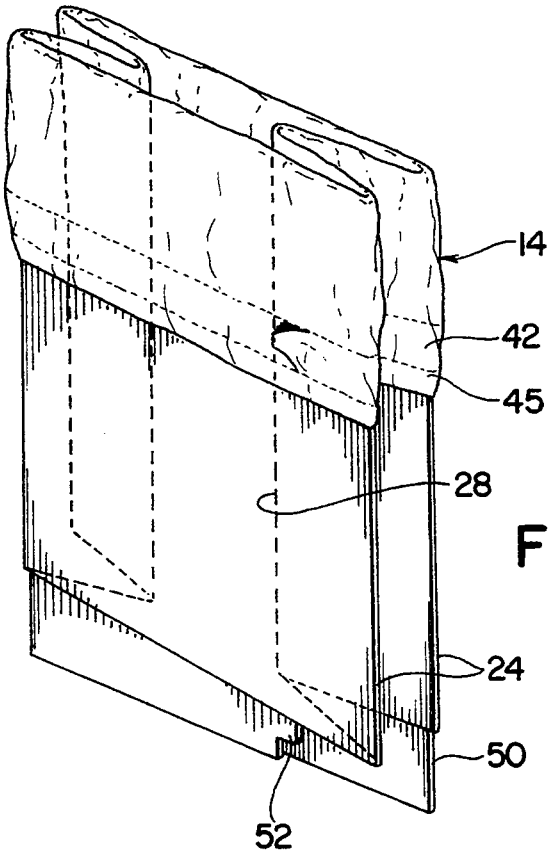
FIG. 2 is a perspective view of the device of the present invention in its flattened storage or non-use position.
Figure 4:
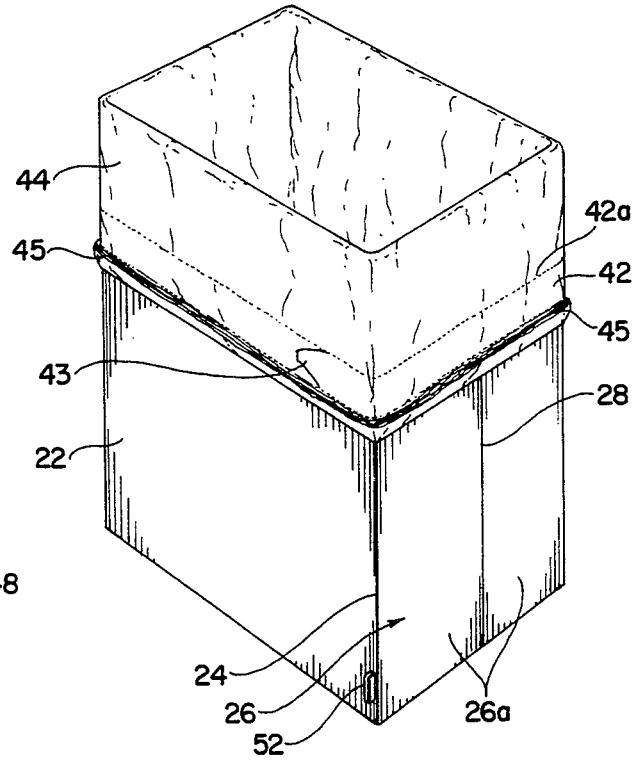
FIG. 4 is a perspective view of the device of the present invention similar to FIG. 1 but showing only the shell and the last remaining bag of the stack thereof remaining.

The lower portions of the bag and bag stacks have been omitted from FIGS. 1, 2 and 4 for clarity.

DETAILED DESCRIPTION OF THE INVENTION

Turning now to the drawings and more particularly to FIGS. 1 and 2, the composite device 10 of the present invention is made up of an outer supporting frame or structure 12 and a nested stack 14 of a plurality of individual bags 16 which may be serially dispensed from such stack. The stack 14 is adapted to fit into the interior portions of the frame or shell 12: and then as trash is placed into the innermost of the individual bags, they are adapted to be serially removed from the composite package after which the frame may also be disposed of.

The frame or container shell 12 is preferably formed of a paper or fiberboard material which is substantially rigid yet which can be folded upon itself to save space and then erected to form a generally rectangular container form exhibiting both open top and bottom areas 18 and 20 respectively. The shell includes a pair or primary panels 22 disposed in face to face relationship to each other and interconnected at their respective vertically oriented side edges 24 by a pair of secondary or side panels 26 also disposed in face to face relationship. The side panels are further provided with a vertically oriented score line 28 preferably centrally disposed in side to side relationship thereto such that the secondary or side panels are divided into generally equally sized sub-panels 26*a* which may be inwardly folded upon each other as shown in FIG. 2 such that the shell 12 and subsequently the entire unit or device 10 may be shipped and stored in a flattened condition. It should be pointed out that the open top 18 is defined by an upper top peripheral edge 32, and it is over this edge that the stack 14 of bags 16 is attached to the frame 12. The panels 24 as well as the panels 26 can be decorated as by imprintation or the application of decals, contact paper, etc. such that the appearance of the outside of the resultant device is enhanced.

The stack 14 comprises a plurality of individual bags 16 nested within each other and exhibiting an imperforate body portion 34, an open top portion 36 which in turn is defined by a peripheral lip 38. Various mechanisms may be utilized in order to provide for the serial detachment of the innermost bag 40 from the stack 14 thereof. In the separation mechanism shown, a plurality of pull tabs 43 are utilized in order to make a peripheral separation band 42 defined by score lines 42*a* along the lip 38 such that the innermost bag 40 may be separated from that bag immediately adjacent thereto. This resultant band 42 may also be utilized to tie off the top of the innermost bag thus separated from the remainder of the stack 14. Such a system is also shown in U.S. Pat. No. 4,417,669 previously discussed and for this reason of showing an operable of bag separation, the disclosure thereof is herewith incorporated into the present specification by specific reference thereto.

The weakened peripheral radial lines 42*a* are, of course, provided such that the inner bag 40 may be easily separated from the underlying bag adjacent thereto which then upon the disposal of the inner bag subsequently becomes the inner bag with respect to the stack 14 and the composite package 10. In order to secure the stack 14 to the frame 12 in a permanent fashion, adhesive may be applied to the outer surface 45*a* of the peripheral lip portions or rim 45 of the outermost bag 44 of the stack 14 thereof and then when that lip is folded upon the top frame edge a permanent attachment of the outermost bag 44 and subsequently the stack thereof takes place since the peripheral rim 45 of all the bags is generally heat fused together during the formation of the stack 14 and the forming of the weakened lines 42*a*. This construction also assures that the rim portion 45 of the outermost bag 44 is permanently attached to the shell 12.

Figure 3:
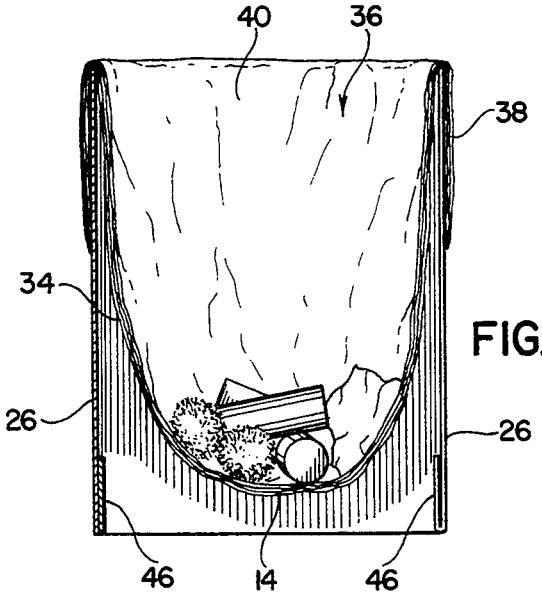
FIG. 3 is a side sectional view along the line 3—3 of FIG. 1 and shows in particular the manner in which nested bags may be serially removed from the supporting structure as they are filled.
Figure 3A:
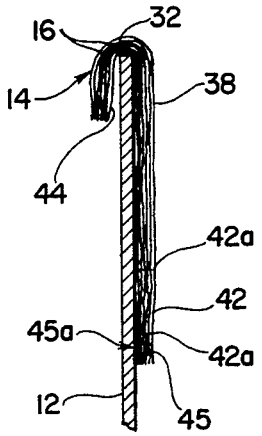
FIG. 3A is an enlarged sectional view similar to FIG. 3 but showing an upper portion of the frame and attached bag stack.
Figure 5:
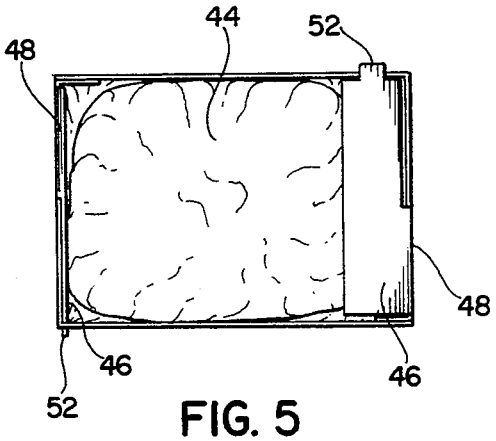
FIG. 5 is a bottom view showing the manner in which the stiffening flaps utilized to add rigidity to the supporting outside structure or frame are attached thereto.

Stiffening means may be provided such that the erected frame in the position shown in FIG. 1 is stabilized if necessary. Often however especially with light use applications, the multiple bag layers in the nested stack 14 thereof and to some extent the material to be disposed of placed in the innermost bag 40 thereof during use tends to keep the frame in its open position. However, flaps 46 extending downward from and integrally attached to the secondary panels may be provided. The flaps 46 include an inner surface 46*a* and an outer surface 46*b*. These flaps 46 as best shown by FIG. 5 are attached to the secondary panels 26 along a connection 48 such that they can be moved from their normal in line extended position shown in FIG. 2 to their folded position shown in FIG. 1 where they are positioned against the inside surface of panels 26 at the lower ends thereof. Also since the flaps 46 are joined to the panels 26 by connections 48 and since the connections 48 are only part way across the extents of panels 26, the flaps need not be centrally creased along a line corresponding to fold line 28. Stated differently, the panels 46 are connected to panels 26 by integral attachment to only one of the panels 26*a* or 26*b* forming the panel 26. Generally, one of the panels 46 is connected to panel 26*a* and the other to panel 26*b* as shown in FIG. 5. Thus the non-folded extent of the panels 46 when folded against creased panels 26 tends to better stiffen them and to thus compensate for the reduced stiffness inherent in the creased panels 26. The inside surfaces of the flaps 46 may be provided with an adhesive coating which can be protected by a temporary cover sheet (not shown) such that greater connection is achieved between the flaps and the respective panels against which they are positioned in the use position as shown in FIGS. 1 and 3. Also or in lieu of flaps 46 with adhesive, the vertical side edges 50 of the flaps may include a tab 52 adapted to extend into a vertical slot 54 provided in the panel 24 when the flap is folded up into the interior of the shell 12 and against the panel 26. Although only one flap/slot has been shown, they may be provided on either side of each flap 46 and in both sides of panels 22.

Accordingly, the completed composite device 12 made up from the frame 12 and the stack 14 can be flattened and stacked for ease in shipment and storage ease prior to use. When utilizing the device, the user merely reaches into the inside of the composite container and pushes outwardly through the walls of bags 16 to force the folded secondary panels of the frame 12 from the position shown in FIG. 2 to that shown in FIG. 1. At this point, the composite device of the present invention is available for use. Subsequently, material to be discarded is thrown into the open top 18 thereof and when the innermost bag 40 is filled to the desired capacity, it is severed from its underlying adjacent bag, disposed of in a suitable fashion and then the composite device 10 is available for re-use without any inconvenience of assembling another bag over the open lip of the container portion. As many bags as practical may be provided in the nest 14 considering the weight, thickness and ultimate purpose of the bag and considering the space taken up by the multiple layers thereof. After the last bag has been discarded, only the shell 12 with the detached rims 45 remain and such may be simply discarded.

It may thus be apparent that a highly useful device which is simple and easy to use and dispose of has been provided by the present invention. Other features and advantages of this invention include that a new, clean bag is always in place; the device saves steps by eliminating having to reach for a new bag each time liner is full; saves bending over to put new liner into container; eliminates fumbling to find bag opening; since the outer container is always new and fresh, such eliminates need to clean dirty outer container; eliminates liner from falling into itself before being filled; uses full capacity of liner by being completely expanded inside of frame; more sanitary than using outer container without liner; and neater and cleaner appearance is achieved due to liners being precisely rolled over rim and attached to outer container.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination disposable package comprising a substantially rigid yet foldable outer container shell having a stack of a plurality of collapsible nested bags attached thereto and in turn disposed for serial detachment therefrom, said outer shell having a pair of opposed primary panels interconnected along vertically oriented primary fold lines to a pair of secondary sides panels each in turn having a centrally disposed vertically oriented secondary fold line such that the shell can be substantially flattened upon itself in a storage position wherein the side panels are folded along said secondary fold lines and then unfolded to an open position wherein the shell defines an open upper top peripheral edge, said collapsible bags each having a closed body and an open upper lip, said bags nested together and interconnected to adjacent bags along a line at their upper lips to form a nested bag stack, said upper lips of said nested bag stack folded over said open upper top peripheral edge of said shell and the nested bodies of said bags disposed adjacent the inside surfaces of said shell panels such that trash may be placed into the body of the innermost bag of said nested stack and then said innermost bag detached from the bag stack and serially disposed of until only said outermost bag and said shell remain as the combination package and may be disposed of as a unit said outermost bag permanently attached to said shell.

2. The combination package of claim 1 wherein means for maintaining said side panels in their open position are included.

3. The combination package of claim 2, said means for maintaining said side panels in an open position being foldable flaps attached to lower surface edge portions of said side panels and upwardly foldable to an open position adjacent lower interior surface portions of said side panels.

4. The combination package of claim 3, there being a vertical fold line in each of said side panels, said flaps integrally attached to said side panels on only one side of said fold line.

5. The combination package of claim 1, said foldable shell being of rectangular configuration.

6. The combination package of claim 1, said innermost bag lip portions including separation means whereby said innermost bag body portion can be separated from its adjacent bag.

7. The combination package of claim 1 wherein said shell is formed of relatively stiff paperboard and said bags are plastic.

8. The combination package of claim 1 wherein said outermost bag lip is permanently attached to said upper top edge of said shell on at least outer surface portions of said panels.

* * * * *